US006129543A

United States Patent [19]

Potskhishvili et al.

[11] Patent Number: 6,129,543

[45] Date of Patent: Oct. 10, 2000

[54] GAS LIGHTER WITH SAFETY DEVICE

[76] Inventors: David Vakhtangovich Potskhishvili, B. Gruzinskaya, d.40, str. 1, kv 19, g., Moscow 123056, Russian Federation; Karlo Vakhtangovich Potskhishvili, Gldanskiy massiv II, m.r. k.28, kv.73, g., Tbilisi 38, 380038, Georgia

[21] Appl. No.: 09/303,608

[22] Filed: May 3, 1999

[51] Int. Cl.[7] ..... F23D 11/36

[52] U.S. Cl. ..... 431/153; 431/277

[58] Field of Search ..... 431/153, 277, 431/255

[56] References Cited

U.S. PATENT DOCUMENTS

| | | | |
|---|---|---|---|
| 3,820,941 | 6/1974 | Piffath et al. . | |
| 4,786,248 | 11/1988 | Nitta . | |
| 4,832,596 | 5/1989 | Morris, Sr. . | |
| 5,074,781 | 12/1991 | Fujita | 431/153 |
| 5,090,893 | 2/1992 | Floriot | 431/153 |
| 5,224,854 | 7/1993 | Ansquer | 431/153 |
| 5,271,731 | 12/1993 | Hsin-Chung . | |
| 5,288,226 | 2/1994 | Khemarangsan | 431/153 |
| 5,356,286 | 10/1994 | Sher | 431/153 |
| 5,417,563 | 5/1995 | Cirami | 431/153 |

FOREIGN PATENT DOCUMENTS

| | | |
|---|---|---|
| 0 357 347 | 3/1990 | European Pat. Off. . |
| 0 482 411 | 4/1992 | European Pat. Off. . |
| 0 611 096 | 4/1998 | European Pat. Off. . |
| WO 90/00239 | 1/1990 | WIPO . |
| WO 90/12254 | 10/1990 | WIPO . |

*Primary Examiner*—Carl D. Price
*Attorney, Agent, or Firm*—McDermott, Will & Emery

[57] ABSTRACT

This invention relates to the field of energy and is directed to a gas lighter with protection from children, that is a lighter in which an ignition mechanism is combined with means for neutralising this mechanism. The lighter comprises a control lever for controlling a burner valve, pivotally mounted on a platform between side ears, a safety device including a cam member positioned in a platform socket and having a protrusion directed toward the control lever for end-to-end cooperation with the lever protrusion, the cam member is formed with a button projecting outward trough a side hole in the platform. The side hole is a horizontally directed slit for receiving the button in a control lever blocking position, in which protrusions of the cam member and of control lever are positioned opposite each other, and is provided with a cut-out for the button in a cam member neutralisation position and for displacing its protrusion relative to the control lever protrusion. The spring is in the form of a rotation spring and its ends are secured on the cam member and the control lever.

1 Claim, 2 Drawing Sheets

GAS LIGHTER WITH SAFETY DEVICE

BACKGROUND OF THE INVENTION

This invention is directed to a gas lighter with protection from children wherein an ignition mechanism is combined with means for neutralising of this mechanism being moveable between a neutralisation operating position in which they prevent initiating the ignition mechanism and a position where they allows such initiating, wherein said neutralising means are moved manually by a lighter user.

Lighters of the above type are known and disclosed in WO, No.A-90/00239 and EP, No.A-0357347 where means for controlling the opening of a burner valve consist of a rocking lever pivotally connected to a fixed axis of an orthogonal axis of the burner valve one end of which, in the shape of a horseshoe or an enclosure, is inserted under a flange of the burner valve, while the other end. or the staring end, is intended for a user to initiate the lighter, which user moves it in a direction of the lighter housing overcoming resistance of a spring, while spark deriving means are themselves independent or combined with the lever for controlling the opening of the valve, and in which ignition mechanism neutralising means are normally maintained in a neutralisation position and are arranged so as to automatically reset into the neutralisation position after the ignition mechanism has been initiated.

Lighters of the above type are known, WO, No.A-90/12254, in which ignition mechanism neutralising means consist of a button disposed under a staring end of a rocking lever, which button is moveable parallel to a longitudinal axis of this rocking lever between an operating position in which this button forms a protrusion with respect to the lever starting end and an unnoticeable position in which it is moved in a direction of the other end of the rocking lever, wherein this button is provided with means for guiding relative to the lighter housing.

According to this known technical solution, the button is horseshoe-shaped wherein each end of the horseshoe is made from an elastic material and bears a protrusion, a bulge, typically disposed under a skirt (casing) enclosing the staring end of the rocking lever so as to interfere with this rocking movement in the direction of the valve opening, wherein additional tapering inclined planes are provided on interior edges of sidewalls of the lighter housing and on button ends in order to cause reduction of a gap from their protrusions when the button moves in a removing direction so as to completely clear the path for the skirt of the rocking lever starting end, whereas the button and the outer rear edge of the skirt of the rocking lever starting end have additional inclined planes of the same inclination capable to cooperate during lowering of this end of the rocking lever to cause movement of the button in a reverse direction into the operating neutralisation position. It is easy to conclude that shape complexity of this button (pusher) and additional complexity of the lighter housing upper portion considerably increase its cost.

A lighter is known, U.S. Pat. No. A-4,832,596, in which control means for opening a valve comprise a rocking lever pivotally fixed on an immovable axis, orthogonal to a burner valve axis, of which one end is formed as a fork or enclosure and inserted under a flange of the burner valve, while the other end of which, or the staring end, is designed for a user to initiate the lighter movement, which user pushes it and displaces it in a direction of the lighter housing thereby overcoming the force of a back-moving spring, wherein spark deriving means are themselves independent or combined with the valve opening control lever, and wherein the ignition mechanism is coupled to means for neutralising this mechanism, consisting of a member moveable between an operating neutralisation position in which said member prevents initiation of the valve opening control lever, while having a portion disposed under a rear end activating this lever, and an unnoticeable removing position wherein said member allows this activation, whereby this member is moved manually by the lighter user from the operating neutralisation position into a position of neutralisation removal and typically is retained in the neutralisation position and, moreover, is arranged to automatically set in the neutralisation position after the ignition mechanism has been set into motion.

In this lighter, the moveable displaceable member comprises a member slidable and forward movably mounted on an upper edge of its housing, wherein this member is provided with a bent rear end typically located under the rear end, activating the control lever, wherein said bent rear end is arranged to move away beyond the rear end which moves the control lever into the neutral position of this member. In this lighter, the forward sliding member is typically retained in the operating position by the back-moving spring and is arranged to move into the neutral position by means of pressure exerted on its front end. Accordingly, during ignition of the lighter, it is necessary to hold the forward-moving member in the neutralisation position as the control lever is set into motion, which is not easy to effect using only one hand. On the other hand, due to the fact that this member is mounted to the side from the lighter head, this forward-moving member runs the risk of being broken or damaged. Finally, its returning into the operating position depends on the presence of its back-moving spring, while its also excessively projects beyond the housing, and there is the risk of it being lost and, consequently, it will cease to function which entails impossibility for the lighter to have the property of a lighter with protection from children.

A gas lighter is known, EP, 0482411, having a safety device intended to prevent the possibility for children to use the lighter and comprising a support member fixed on a housing which is a receptacle for liquidified gas, which support member comprises a platform provided with a hole from one edge for mounting therein a burner valve for gas emission, and provided with side ears with holes, a burner valve control lever mounted on the platform between the side ears and formed at one end together with a fork or enclosure to enclose with a flange a head of the burner valve, and with co-axially disposed axes located in the side ear holes, wherein the other end of the control lever, intended to be depressed by a user, is provided with a protrusion directed toward the platform, ignition means comprising a gearwheel rotatably mounted in the platform ears over the control lever, and a flint pressed by a spring toward this gearwheel, as well as a safety device including a cam member located in a platform socket and pressed by a spring mounted on the cam foot, and having a protrusion directed toward the control lever for end-to-end interaction with the lever protrusion, wherein the cam is pivotably mounted in the platform socket and is provided with a button projecting outside through a side hole in the platform, said side hole being a horizontally directed slit for accommodating the button in a control lever blocking position, wherein the cam and control lever protrusions are opposite to and face each other, whereby the horizontal slit is formed at one end with button through cut-out vertically directed toward the lever in a cam neutralisation position when its protrusion is biased relative to the control lever protrusion.

Although this lighter does possess the property of protecting it from use by children, design of the safety device does not fully meet the requirements of technological methods of production and convenience of assembling the lighter.

Thus, for example, in this lighter a spring is positioned between the bottom of a socket and a lower surface of the cam member. The lighter design uses a rotation spring whose ends must be secured to prevent turning of the spring when the cam member is displaced relative to the platform. When securing one end of this spring to a foot of the cam member presents no difficulties, securing the other end of the spring in the socket is a complex operation since it is only possible when the cam member is located in the socket but here the access to the spring is blocked. In this connection, the conclusion about low repair capability of the lighter is apparent.

BRIEF DESCRIPTION OF THE INVENTION

The object of the present invention is to provide a gas lighter with protection from children wherein a cam automatically returns into control lever blocking position after a user has removed pressing force from the control lever, and wherein the possibility is eliminated of removing the blocking as a result of the button accidental displacement in the control lever blocking position whereby the lighter design must be technologically feasible and ensure convenience of assembling and possibility of its repair.

According to the invention, this problem is solved by provision of a gas lighter with a safety device intended to prevent the possibility of children using the lighter which comprises a support part fixed on a housing being a receptacle for liquidified gas, said support part being a platform provided with a hole at one edge for mounting therein a gas emission burner valve, and having side ears with holes, a burner valve control lever mounted on the platform between the side ears and formed at one end with a fork or enclosure to enclose with a flange a head of the gas emission burner valve, and with co-axially disposed axes located in the holes of said side ears, wherein the other end of the control lever intended to be depressed by the a user is provided with a protrusion directed toward the platform, ignition means including a gearwheel rotatably mounted in the platform ears over the control lever, and a flint pressed by a spring toward this gearwheel, as well as safety device including a cam member placed in the platform socket and pressed by a spring and having a protrusion directed toward the lever for end-to-end interaction with the lever protrusion, wherein the cam member is pivotably mounted in the platform socket and is provided with a button which projects outward through a platform side hole, while said side hole comprises a horizontally directed slit for receiving the button in a control lever blocking position, wherein the cam member and control lever protrusions are opposite to each other, wherein the horizontal slit is formed at one end with the button through cut-out vertically directed toward the cam member in a cam member neutralisation position, when its protrusion is displaced relative to the control lever protrusion, a cam member foot is formed as a rib, from the side of the protrusion the cam member is provided with a fixing member for one end of the spring being a rotational spring, another end of which is coupled with a fixing member of the other end of this spring located on the control lever from the side of the protrusion of the latter, whereby the rib is positioned perpendicularly to a vertical plane extending through the button.

DETAILED DESCRIPTION OF THE DRAWINGS

The present invention is illustrated with the following drawings which represent the preferred embodiments of the lighter but are not unique and demonstrate the possibility to achieve the desired result using totality of essential features provided in the claims.

FIG. 1 is a side view of the lighter with partial section of the platform in initial position when the safety device is on;

DETAILED DESCRIPTION OF THE INVENTION

Figure 2:
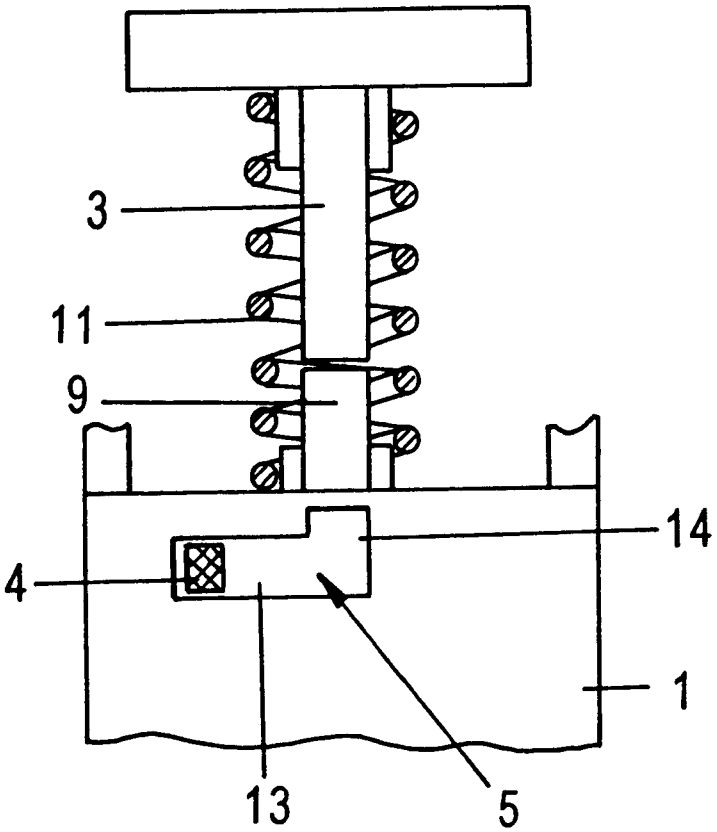
FIG. 2 is a lighter view according FIG. 1 from the side of the button.
Figure 1:
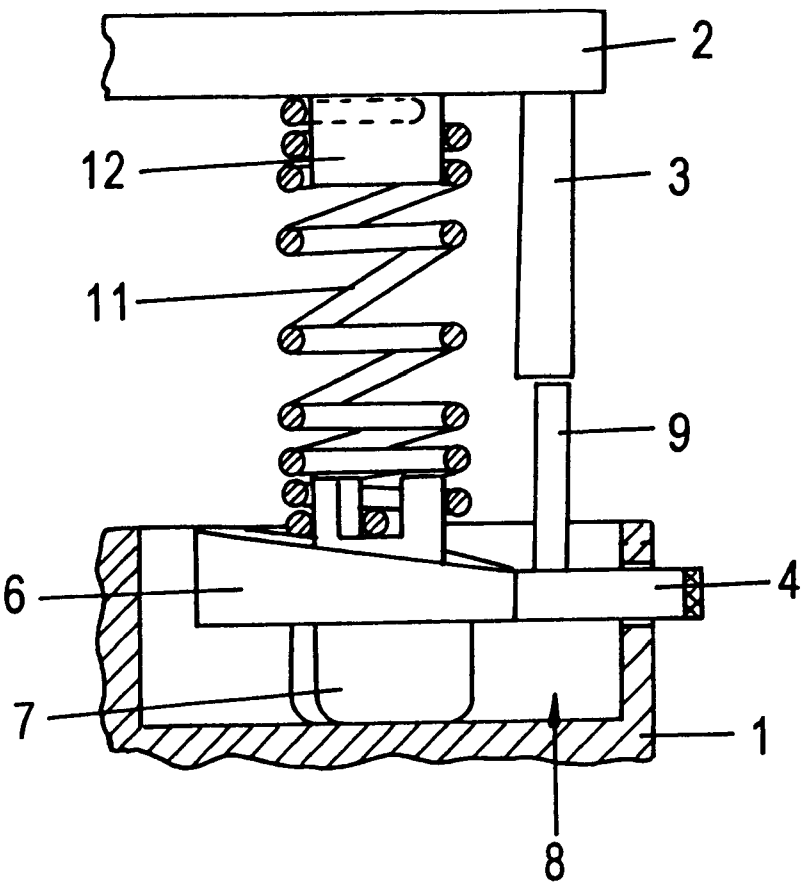

As illustrated in FIGS. 1 and 2, the lighter according to the present invention is a gas lighter a hollow housing of which made of a polymeric material is a receptacle for liquidified gas. The housing is closed at the top with a cover being a support part for a control mechanism, ignition means and a safety device.

The support part is a platform 1 having a through hole for mounting therein a gas emission burner valve. The platform is provided with side ears in which axes of the burner valve control lever 2 are located. This lever is formed at one end with a fork or enclosure for enclosing a head of the gas emission burner valve with a flange, whereby another end of control lever 2 intended to be depressed by a user is provided with protrusion 3 directed toward platform 1.

Ignition means include gearwheel mounted over the control lever and rotatably installed in the holes of the platform ears as well as a flint pressed by a spring toward this gearwheel. The flint, together with the spring which presses it against the gearwheel, is mounted in the platform body and is passed through a central opening (not shown) in the control lever.

These particular embodiments of the lighter are not illustrated since they represent commonly known solutions.

The lighter is equipped with the safety device (FIGS. 1 and 2) which is controlled by a button 4 and which is designed to block pivoting of the control lever. The button is a small lever projecting outward through side hole 5 in the platform from the side of the control lever end to be depressed by the user.

Figure 3:
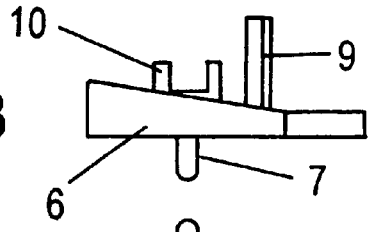
FIG. 3 shows the side view of the cam member.
Figure 4:
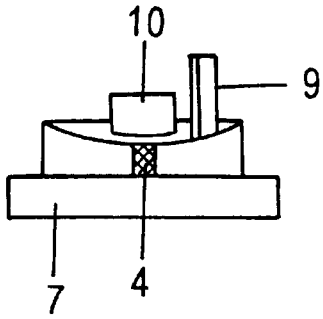
FIG. 4 shows the same as FIG. 3, view from the side of the button.
Figure 5:
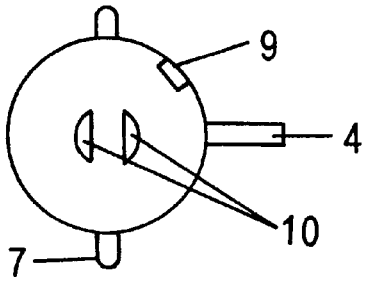
FIG. 5 shows the same as FIG. 3, top view.

The button is associated with cam member 6 shaped as a disc in the plan view (FIGS. 3 to 5), which carries from one side a foot in the form of rib 7 by which the cam member disposed in socket 8 of the platform bears against the bottom of the socket. The rib is positioned perpendicular to a vertical plane extending through the button. The side of the disc opposite to the foot is provided with protrusion 9 located at the disc periphery, and fixing member 10 for fixing spring 11 is formed by a rotation spring in which a gap is formed between coils or the coils are spaced from each other by a distance the total amount of which, along the spring length, is selected based on the condition that this spring, when the lever turns toward the platform at the time of flame ignition, being compressed, would not impede this action. Fixing member 10 may be formed in any way, it is required to secure one end of the rotation spring and to eliminate pivoting of this end relative to the disc of the cam member.

Control lever 2, from the side of its protrusion 3, is also provided with a responding fixing member 12 for another end of rotation spring 11. Thus the cam member and the lever are coupled to each other by the rotation spring providing spring connection therebetween which retains the control lever and the cam member relative to each other in a position of constant dependence.

It is precise in this position that protrusion 3 of the control lever is located over protrusion 9 of the cam member in such a way that, when the control lever is depressed, its protrusion abuts the end of protrusion 9 of cam member (FIG. 2) which precludes the possibility for the control lever to turn by an angle sufficient for the burner valve to be opened.

Figure 7:
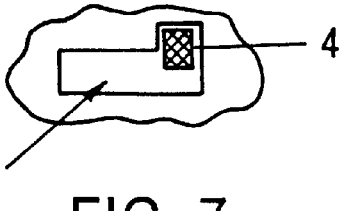
FIG. 7 shows the button position when the safety device is off.
Figure 8:
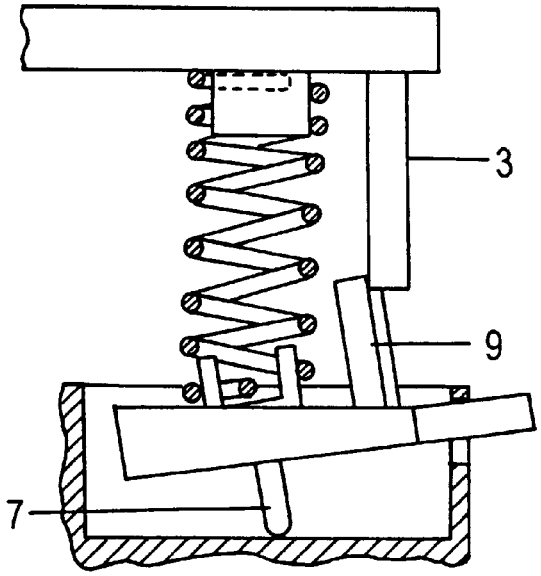
FIG. 8 is a lighter view according to fig.1 when the safety device is off.

Side hole 5, as shown in FIG. 2, is a horizontally directed slit 13 for receiving button 4 in the control lever blocking position (FIG. 2) in which protrusions of the cam member and control lever are placed opposite each other, wherein the horizontal slit is formed at one end with through cut-out 14 vertically directed toward the lever to receive the button in the cam member neutralisation position and to bias its protrusion relative to the protrusion of the control lever (FIG. 7).

The lighter with protection from children operates as follows.

In the initial position (FIGS. 1 and 2), button 4 is in horizontal slit 13 of the side hole in an extreme position which is opposite to location of cut-out 14. Control lever 2 is located with its protrusion 3 opposite to protrusion 9 of the cam means. Mutual position of the lever and cam member elements is determined by the fact that they are interconnected by rotation spring 11 to which no external forces are applied. If the button is accidentally displaced from the initial position, the rotation spring will return it in the initial position after the button has been released.

When control lever 2 is depressed with a finger, its protrusion abuts protrusion 9 of the cam member which precludes the possibility of turning control lever by an angle sufficient for the burner valve to be opened. Movement of the cam member relative to its rib being a support and a pivot is impeded by the button itself because it bears against a lower wall of horizontal slit 13.

In this initial position, the control lever is neutralised and the possibility is eliminated to ignite the burner valve when the control lever is depressed.

Figure 6:
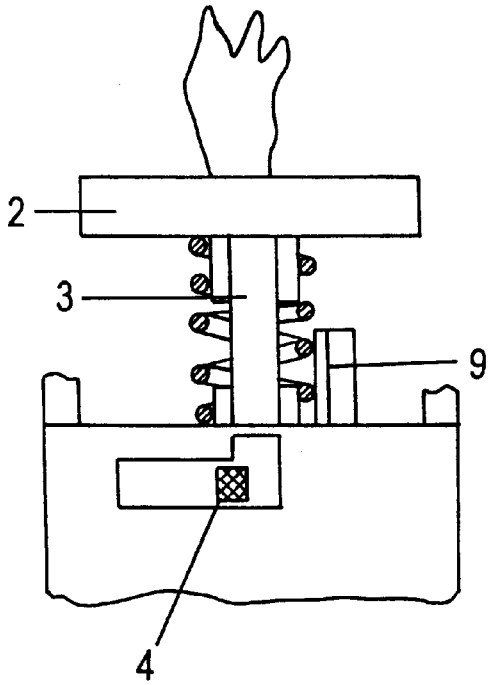
FIG. 6 is a view of the lighter according to FIG. 1 from the side of the button when the safety device is off.

In order to eliminate control lever neutralisation and to realise the possibility of igniting the burner valve, it is necessary to apply to button 4 a force, to bias it along the horizontal slit (FIG. 6) and to move the button into the cut-out (FIG. 7) shaped to match the shape of the button. When the button is moved, rotation spring 11 winds up. Preferably, button 4 has a rectangular cross-section so that by its sidewall the button can bear against a flat wall of the cut-out. Thus button 4 is fixed in cut-out 14.

When the button moves along the horizontal slit, the cam member turns and its protrusion 9 is released from its position under protrusion 3 of the control lever and is displaced away from it.

When the control lever is depressed, the latter pivots about its axes toward the platform, its protrusion is received by socket 8, ignition of gas occurs.

When the control lever is in its lower position wherein the burner valve is open, protrusion 3 bears against the surface of the cam member and turns it about the rib so that button 4 is released from the cut-out and descends until it abuts the lower wall of the horizontal slit.

As long as the user holds the lever in its depressed position, the cam member is in an unfixed position. When the control lever is released, the latter rises upward, rotation spring 11, unwinding, returns the button together with the cam member into the initial position in which both protrusions 3 and 9 are located opposite each other taking the place corresponding to turning on blocking of the control lever.

We claim:

1. A gas lighter with safety device intended to prevent children from using the lighter, the lighter comprising:

a support part fixed on a housing being a receptacle for liquidified gas and presenting a platform a control lever for controlling a burner valve for gas emission, an end of the control lever intended to be depressed by a user is provided with a lever protrusion directed toward said platform, a safety device including a cam member located in a platform socket and pressed by a spring, and having a cam protrusion directed toward said control lever for end-to-end cooperation with said lever protrusion, said cam member is rotatably mounted in said platform socket and is formed with a button projecting outward through a side hole in the platform, said side hole being a horizontally directed slit for receiving the button in a control lever blocking position in which said lever and cam protrusions of said cam member and said control lever are positioned opposite each other, said horizontal slit being formed at one end with a through cut-out vertically directed toward the lever, said cut-out being for the button in a cam member neutralisation position and for displacing the cam protrusion relative to the said protrusion of said control lever, a foot of said cam member is in the form of a rib, said spring is in the form of rotation spring, on the side of said cam protrusion, the cam member is provided with a first fixing element for fixing one end of said spring, another end of said spring is associated with a second fixing element for fixing the other end of said spring, said second fixing element is located on said control lever on the side of protrusion of said lever.

* * * * *